United States Patent [19]

Myers

[11] Patent Number: 4,872,615

[45] Date of Patent: Oct. 10, 1989

[54] FLUID-JET-CUTTING NOZZLE ASSEMBLY

[75] Inventor: Terrance L. Myers, Columbus, Kans.

[73] Assignee: Ingersoll-Rand Company, Woodcliff Lake, N.J.

[21] Appl. No.: 319,039

[22] Filed: Mar. 6, 1989

Related U.S. Application Data

[63] Continuation of Ser. No. 161,631, Feb. 29, 1988, abandoned.

[51] Int. Cl.[4] ..... B05B 15/08

[52] U.S. Cl. ..... 239/587; 51/439; 239/600; 285/261

[58] Field of Search ..... 239/433, 434, 587, 600; 51/439; 285/261

[56] References Cited

U.S. PATENT DOCUMENTS

| | | | |
|---|---|---|---|
| 210,910 | 12/1878 | Brady | 285/261 |
| 1,597,477 | 8/1926 | Panhorst | 239/587 |
| 1,730,348 | 10/1929 | Anstiss | 285/261 |
| 4,497,444 | 2/1985 | Arnold | 239/587 |
| 4,545,157 | 10/1985 | Saurwein | 239/433 |
| 4,555,872 | 12/1985 | Yie | 51/439 |
| 4,648,215 | 3/1987 | Hashish | 51/439 |
| 4,802,313 | 2/1989 | Smith | 51/439 |
| 4,817,874 | 4/1989 | Jarzebowicz | 239/587 |

*Primary Examiner*—Andres Kashnikow
*Assistant Examiner*—Michael J. Forman
*Attorney, Agent, or Firm*—James R. Bell

[57] ABSTRACT

The assembly comprises a centrally-bored nozzle and centrally-bored nozzle body, the two being in substantially collinear alignment along a longitudinal axis, and a collar and locking ring, for swivelingly coupling the nozzle and body together, andd releasably locking the two together in selected, swiveled displacements from such alignment.

4 Claims, 2 Drawing Sheets

FLUID-JET-CUTTING NOZZLE ASSEMBLY

This is a continuation, of application Ser. No. 161,631 filed Feb. 29, 1988 now abandoned.

This invention pertains to fluid-jet-cutting apparatus, and in particular to a fluid-jet-cutting nozzle assembly such as is used in such apparatus.

The nozzle assemblies to which this invention pertains commonly comprise a nozzle body, and a nozzle, the two being centrally bored and disposed for longitudinal alignment of the bores substantially along an axis, and a nut, or some such fastener, securing the nozzle and body together in the aforesaid alignment.

Due to manufacturing tolerances, and machining imprecisions, it frequently occurs that the body and nozzle bores are not in true, axial alignment. Consequently, the highly-pressured fluid jet, passing through the bore in the body, can enter the bore in the nozzle slightly off center, and migrate toward, and impinge against, the wall of the nozzle bore. As a result, and especially if the jet has abrasive particulate therein, the nozzle bore becomes distorted, and the nozzle itself is soon unusable and must be replaced.

What has been needed is a fluid-jet-cutting nozzle assembly which will accommodate for the aforesaid tolerances and imprecisions, by allowing for alignment adjustments.

It is an object of this invention to meet just such a need.

It is particularly an object of this invention to set forth a fluid-jet-cutting nozzle assembly, comprising a nozzle body; and a nozzle; wherein said body and nozzle have central bores; said body has a fluid jet discharge end; an end of said nozzle is interfaced with said discharge end to effect a substantially collinear alignment of said bores along a longitudinal axis; and means, engaging both said nozzle and said body, adjustable for effecting relative movement between said nozzle and said body, for displacing one of said bores, relative to the other thereof, both toward and away from axial alignment with said other bore.

It is also an object of this invention to disclose a fluid-jet-cutting nozzle assembly, comprising a nozzle body; and a nozzle; wherein said body and nozzle have central bores; said body has a fluid jet discharge end; an end of said nozzle is interfaced with said discharge end to effect a substantially collinear alignment of said bores along a longitidunal axis; and means swivelingly coupling said body and nozzle together, for retaining an interface between said end of said nozzle and said discharge end of said body, and adjustable for effecting swiveling movement, between said body and nozzle, for displacing one of said bores, relative to the other thereof, both toward and away from axial alignment with said other bore.

Further objects of this invention, as well as the novel features thereof, will become more apparent by reference to the following description taken in conjunction with the accompanying figures, in which.

Figure 1:
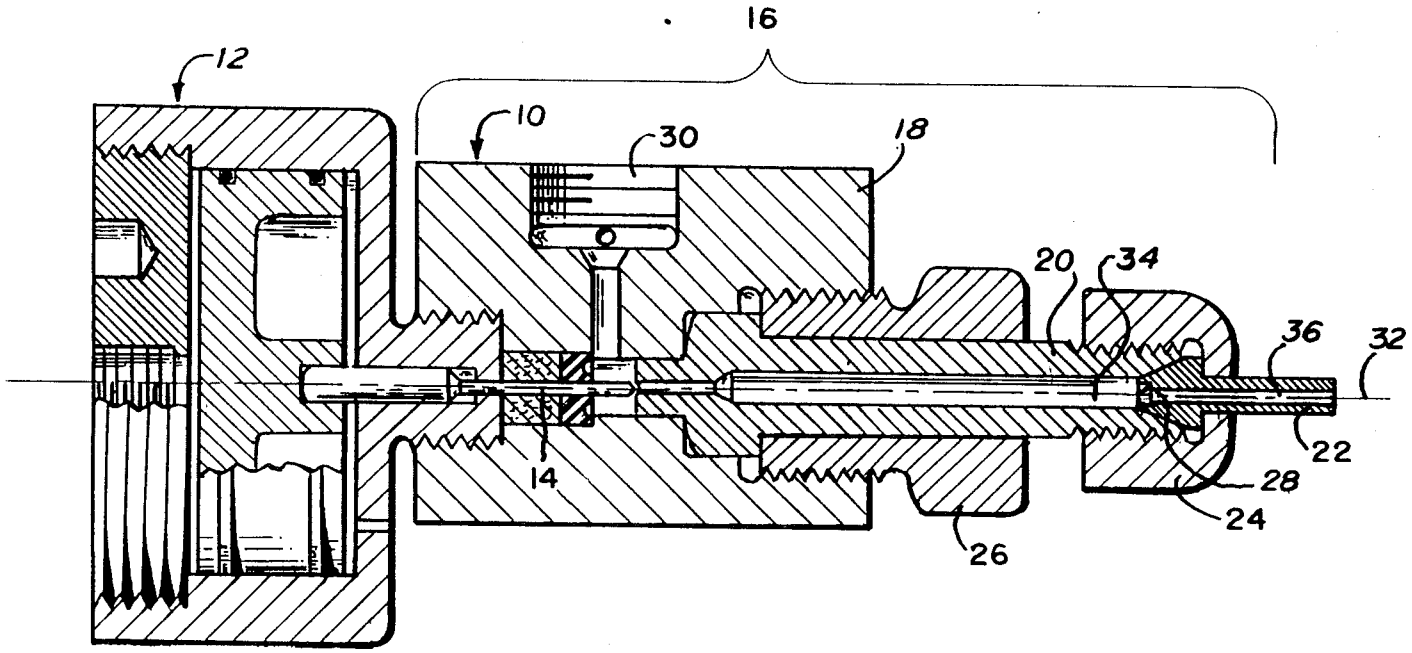
FIG. 1 is a longitudinal cross-section through a known fluid-jet-cutting nozzle assembly.

The nozzle assembly 10 depicted in FIG. 1 is an embodiment of the invention of Raymond M. Jordan, the applicant in U. S. patent application No. 2,379, filed on Jan. 12, 1987, for a (pneumatically-controlled) Nozzle Assembly. The structure 12 at the left of the illustration is not material to this disclosure, and is fully described in the cited application (which is incorporated by reference for any explanation deemed necessary). Disregarding the plunger 14, the structure encompassed by the bracket 16 is exemplary of prior art nozzle assemblies.

The bracketed assembly 16 comprises a housing 18, a nozzle body 20, a nozzle 22, a retaining nut 24, and a second retaining nut 26. The latter secures the centrally-bored body in the housing 18, and nut 24 fixes the nozzle 22 to the discharge end 28 of the body 20. The port 30 in the housing admits the pressured fluid to the body 20 and nozzle 22.

Figure 2:
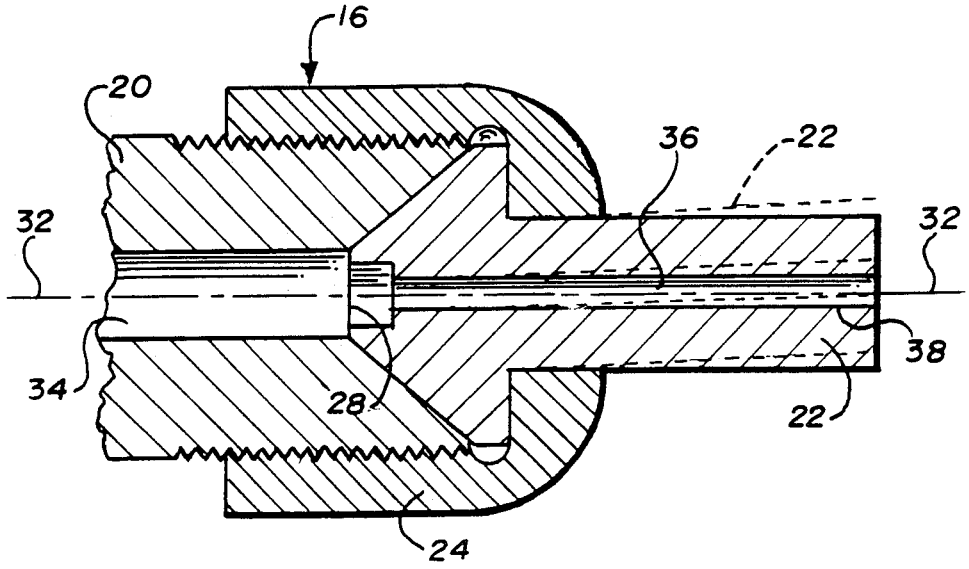
FIG. 2 is a greatly enlarged illustration of the discharge end of the FIG. 1 assembly.

In considerable enlargement, FIG. 2 depicts the outer end of the body 20, the nozzle 22, and the nut 24. As can be appreciated, the arrangement shown in FIG. 2 provides for no alignment adjustment of the components. If, due to manufacturing tolerances and/or machining imperfections, the nozzle 22 is slightly askew from the central axis 32, as shown in dashed outline, and/or a cohesive fluid jet stream passes through the bore 34 of the body 20 with a slight axial displacement, it will enter the bore 36 of the nozzle off center and impinge on the wall 38 of the nozzle 22. The dash-dotted line shows the stream making such a traverse of the assembly 16.

Figure 3:
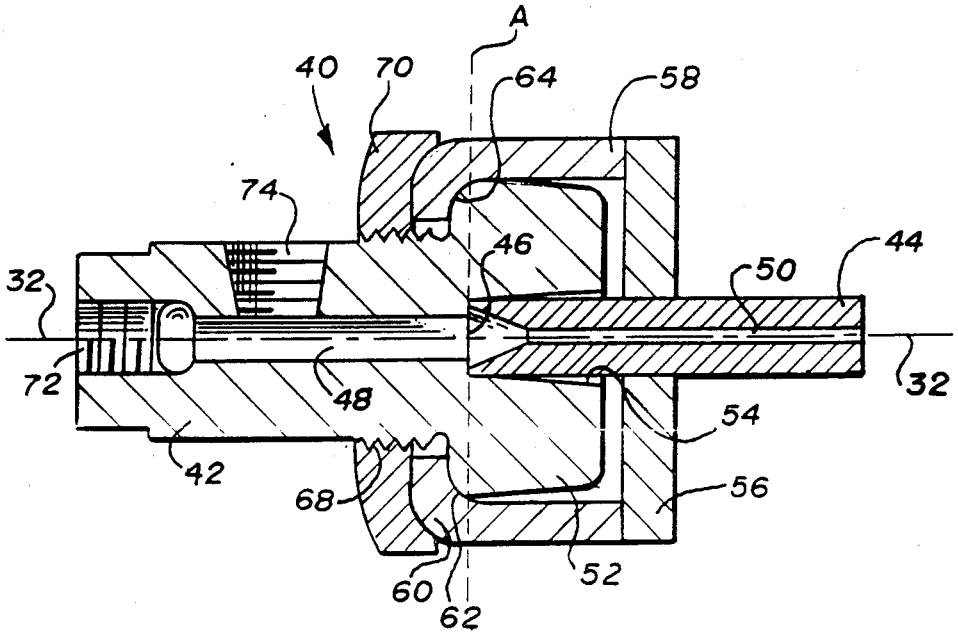
FIG. 3 is a longitudinal cross-section of a nozzle assembly according to an embodiment of the invention.

FIG. 3 shows an embodiment of the invention, the same comprising the nozzle assembly 40. Herein is a nozzle body 42, and a nozzle 44. Both are centrally bored and the inner end of the nozzle 44 is interfaced with the fluid discharge end 46 of the body 42, to effect a substantially collinear alignment of the body bore 48 with the nozzle bore 50.

The body 42 has an enlarged shoulder 52 at its terminal end, and a conical opening 54 centrally formed in said end. The nozzle 44 has an inner end which is set into the opening 54. The nozzle 44 is in penetration of, and is secured (by means not shown, such as brazing, or the like) in an apertured plate 56. The plate 56 is fastened (by hardware not shown) to a collar 58. The collar 58 has a rim 60 which slidably and swively engages the shoulder 52.

The shoulder 52 has a convex surface 62, and the rim 60 has a concave surface 64. It is the mutual engagement of these surfaces 62 and 64 which provides for a swiveling engagemnt or coupling between the nozzle 44 (and plate 56 and collar 58) and the body 42. Hence, if a fluid-jet stream passes through bore 48 slightly divergent from the axis 32, the collar 58 can be displaced to align the nozzle bore 50 at an orientation which will allow the stream to pass through the bore 50 in the center thereof. To achieve an optimum alignment of the body 42 and the nozzle 44, the rim 60 and shoulder 52 need to effect contact in the same relative plane "A" whereat the fluid discharge end 46 subsists.

The body 42 has an externally-threaded portion 68 which receives thereon an internally-threaded locking ring 70. The ring 70 is provided to lock the collar 58 in a selected positioning and, to accommodate for such locking in differing attitudes of the collar 58, the interfacing surfaces of the ring 70 and the rim 60 (of collar 58) are complimentary and nestable. As will be understood from prior art nozzle assemblies, the fluid-jet-stream enters the assembly 40 via the port 72, and port 74 is provided for admitting an abrasive particulate to the stream.

While I have described my invention in connection with a specific embodiment thereof, it is to be clearly understood that this is done only by way of example, and not as a limitation to the scope of my invention as set forth in the objects thereof and in the appended claims.

I claim:

1. A fluid-jet-cutting nozzle assembly, comprising:

a nozzle body; and a nozzle; wherein said body has a fluid jet discharge end;

one end of said nozzle is interfaced at a plane with said discharge end;

an enlarged shoulder having an arcuate surface adjacent the discharge end of the nozzle body, the nozzle body having a central bore formed therein and a conical opening formed in the discharge end, a wider end of the conical opening being downstream of a narrower end of the conical opening., the central bore and the conical opening interfacing at the plane, said plane passing through the arcuate surface formed on the shoulder;

the nozzle also having a central bore including an enlarged portion at the one end thereof, the nozzle being mounted in the conical opening of the nozzle body such that the enlarged portion interfaces at the plane, the central bores of the nozzle body and the nozzle being in substantial alignment and an external transverse dimension of the nozzle being smaller than a transverse dimension of the conical bore at corresponding locations.

a collar having a portion closely encircling the nozzle and said collar interconnecting the nozzle and the nozzle body, the collar having an arcuate rim in mating engagement with the arcuate surface of the shoulder; and means for locking the collar in a selected position, the locking means having an arcuate surface in engagement with the arcuate rim of the collar.

2. Apparatus for achieving optimum alignment of a nozzle in a nozzle body, comprising:

an enlarged shoulder at a discharge end of the nozzle body, the nozzle body having a central bore formed therein and a conical opening formed in the discharge end, a wider end of the conical opening being downstream of a narrower end of the conical opening., the central bore and the conical opening interfacing at a plane passing through an arcuate surface formed on the shoulder;

the nozzle also having a central bore including an enlarged portion at one end thereof, the nozzle being mounted in the conical opening of the shoulder such that the enlarged portion interfaces at the plane, the central bores of the nozzle body and the nozzle being in substantial alignment and an external transverse dimension of the nozzle being smaller than a transverse dimension of the conical bore at corresponding locations.;

a collar having a portion closely encircling the nozzle and said collar interconnecting the nozzle and the nozzle body, the collar having an arcuate rim in mating engagement with the arcuate surface of the shoulder; and means for locking the collar in a selected position, the locking means having an arcuate surface in engagement with the arcuate rim of the collar.

3. The apparatus of claim 2, wherein the locking means is threadedly engaged with the nozzle body.

4. The apparatus of claim 3, wherein the central bore of the nozzle body is of a first diameter at the plane and the enlarged portion of the central bore of the nozzle is of a second diameter at the plane which is greater than the first diameter at the plane.

* * * * *